US008670871B2

(12) United States Patent
Nishino et al.

(10) Patent No.: US 8,670,871 B2
(45) Date of Patent: Mar. 11, 2014

(54) LOAD PROCESSING BALANCE SETTING APPARATUS

(75) Inventors: Atsushi Nishino, Kusatsu (JP); Satoshi Hashimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 447 days.

(21) Appl. No.: 13/139,752

(22) PCT Filed: Dec. 21, 2009

(86) PCT No.: PCT/JP2009/007047

§ 371 (c)(1),
(2), (4) Date: Jun. 15, 2011

(87) PCT Pub. No.: WO2010/073579

PCT Pub. Date: Jul. 1, 2010

(65) Prior Publication Data

US 2011/0257794 A1 Oct. 20, 2011

(30) Foreign Application Priority Data

Dec. 26, 2008 (JP) ..... 2008-334590

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |
| *F28F 13/00* | (2006.01) |

(52) U.S. Cl.
USPC ..... 700/277; 700/276; 700/278; 700/299; 700/300; 165/261; 165/263; 236/1 B; 236/1 C

(58) Field of Classification Search
USPC ..... 700/276–278, 299–300; 165/261, 263; 236/1 B, 1 C
See application file for complete search history.

(56) References Cited

U.S. PATENT DOCUMENTS

2002/0053217 A1* 5/2002 Chua et al. ..... 62/480
2005/0258259 A1* 11/2005 Stanimirovic ..... 236/49.1

(Continued)

FOREIGN PATENT DOCUMENTS

| | | | |
|---|---|---|---|
| JP | 6-185783 | A | 7/1994 |
| JP | 10-185277 | A | 7/1998 |
| JP | 2005-201509 | A | 7/2005 |

OTHER PUBLICATIONS

International Search Report of corresponding PCT Application No. PCT/JP2009/007047.

(Continued)

*Primary Examiner* — Ramesh Patel
(74) *Attorney, Agent, or Firm* — Global IP Counselors

(57) ABSTRACT

A load processing balance setting apparatus includes first and second air-conditioners for targeted first and second areas, a calculating unit, a determining unit and an adjusting unit. The first area is included within the second area. The calculating unit calculates a sum of an air-conditioning load for the first and second air-conditioners. Preferably, the determining unit determines a first and second processing throughputs for the first and second air-conditioners so that a COP (Coefficient of Performance) for the sum of the air-conditioning loads calculated by the calculating unit is maximized or is equal to or greater than a predetermined level, or so that a power consumption level for the sum of the air-conditioning loads calculated by the calculating unit is minimized or is equal to or less than a predetermined level. The adjusting unit controls the first and second air-conditioners based on the first and second processing throughputs.

4 Claims, 8 Drawing Sheets

(56) References Cited

U.S. PATENT DOCUMENTS

| | | | | |
|---|---|---|---|---|
| 2007/0068184 | A1* | 3/2007 | Mueller et al. | 62/260 |
| 2008/0288193 | A1* | 11/2008 | Claassen et al. | 702/61 |
| 2010/0050628 | A1* | 3/2010 | Staffend et al. | 60/508 |

OTHER PUBLICATIONS

International Preliminary Report of corresponding PCT Application No. PCT/JP2009/007047.

* cited by examiner

DIFFERENCE IN ENTHALPY BETWEEN
HEATING AND COOLING (MOLLIER DIAGRAM)

TRANSITION IN AIR-CONDITIONER LOAD FACTOR AND COP FOR AIR-CONDITIONERS WHEN CONTROLLED TO CHANGE CURRENT AIR-CONDITIONER LOAD TO OPTIMUM LOAD THROUGHPUT

| | AMBIENT | TASK | TOTAL |
|---|---|---|---|
| AIR-CONDITIONER LOAD FACTOR | −10% | +10% | 0 |
| COP | −5% | +30% | +25% |

<OPTIMUM LOAD THROUGHPUT FOR TASK AIR-CONDITIONER>

| | | CURRENT TOTAL AIR-CONDITIONING LOAD [kWh] | | | |
|---|---|---|---|---|---|
| | | 0~5 | 5~10 | 10~15 | 15~20 |
| CURRENT AIR–CONDITIONING LOAD OF TASK AIR–CONDITIONER [kWh] | 0~5 | 0 | 0 | NO CONTROL | NO CONTROL |
| | 5~10 | – | 0 | NO CONTROL | NO CONTROL |
| | 10~15 | – | – | 12 | 12 |

<OPTIMUM LOAD THROUGHPUT FOR AMBIENT AIR-CONDITIONER>

| | | CURRENT TOTAL AIR–CONDITIONING LOAD [kWh] | | | |
|---|---|---|---|---|---|
| | | 0~5 | 5~10 | 10~15 | 15~20 |
| CURRENT AIR–CONDITIONING LOAD OF AMBIENT AIR–CONDITIONER [kWh] | 0~5 | NO CONTROL | NO CONTROL | NO CONTROL | NO CONTROL |
| | 5~10 | – | NO CONTROL | 0 | NO CONTROL |
| | 10~15 | – | – | 0 | 8 |

FIG. 6

LOAD PROCESSING BALANCE SETTING APPARATUS

CROSS-REFERENCE TO RELATED APPLICATIONS

This U.S. National stage application claims priority under 35 U.S.C. §119(a) to Japanese Patent Application No. 2008-334590, filed in Japan on Dec. 26, 2008, the entire contents of which are hereby incorporated herein by reference.

TECHNICAL FIELD

The present invention relates to a load processing balance setting apparatus for adjusting the air-conditioning load of each air-conditioner in an air-conditioning system having a plurality of air-conditioners.

BACKGROUND ART

There is currently an air-conditioning system in which the operating status of a task air-conditioner for air-conditioning a targeted predetermined area only is used to control the operating conditions of an ambient air-conditioner for air-conditioning a targeted area including the predetermined area within this area (see Japanese Laid-open Patent Publication No. 6-185783).

SUMMARY

Technical Problem

However, there are times when the ambient air-conditioner in this type of air-conditioning system operates needlessly because the operating conditions for the ambient air-conditioner are determined by the operating status of the task air-conditioner. As a result, the coefficient of performance (COP) of the air-conditioners may not improve in an overall sense. Thus, energy conservation may not actually be realized.

Therefore, an object of the present invention is to provide a load processing balance setting apparatus able to conserve energy by adjusting the air-conditioning load of each air-conditioner.

Solution to Problem

A load processing balance setting apparatus according to a first aspect of the present invention has a first air-conditioner, a second air-conditioner, a calculating unit, a determining unit, and an adjusting unit. The first air-conditioner air-conditions a targeted first area. The second air-conditioner air-conditions a targeted second area having the first area included within the area. The calculating unit calculates the sum of an air-conditioning load for the first air-conditioner and the second air-conditioner. The determining unit determines a first processing throughput for the first air-conditioner and a second processing throughput for the second air-conditioner so that a COP for the sum of air-conditioning loads calculated by the calculating unit is maximized or is equal to or greater than a predetermined level. The adjusting unit controls the first air-conditioner based on the first processing throughput determined by the determining unit. The adjusting unit also controls the second air-conditioner based on the second processing throughput determined by the determining unit.

In the load processing balance setting apparatus in the first aspect of the present invention, the first processing throughput and the second processing throughput are determined so that the COP for the sum of the air-conditioning load of the first air-conditioner and the air-conditioning load of the second air-conditioner is maximized or is equal to or greater than a predetermined level. Also, the first air-conditioner and the second air-conditioner are controlled based on the determined first processing throughput and second processing throughput. In this way, the overall COP for the air-conditioners is improved without changing the overall air-conditioning load for the air-conditioners.

Thus, energy can be conserved by adjusting the air-conditioning loads of the air-conditioners.

A load processing balance setting apparatus according to a second aspect of the present invention is the load processing balance setting apparatus of the first aspect of the present invention in which the determining unit determines the first processing throughput and the second processing throughput by performing an arithmetic calculation to maximize an objective function related to the COP subject to a limiting condition. In this way, the load processing balance setting apparatus can determine the first processing throughput and the second processing throughput.

A load processing balance setting apparatus according to a third aspect of the present invention is the load processing balance setting apparatus of the first aspect of the present invention in which the determining unit determines the first processing throughput and the second processing throughput based on a setting value set in advance for the sum of the air-conditioning loads. In this way, the load processing balance setting apparatus can determine the first processing throughput and the second processing throughput.

A load processing balance setting apparatus according to a fourth aspect of the present invention has a first air-conditioner, a second air-conditioner, a calculating unit, a determining unit, and an adjusting unit. The first air-conditioner air-conditions a targeted first area. The second air-conditioner air-conditions a targeted second area having the first area included within the area. The calculating unit calculates the sum of the air-conditioning loads for the first air-conditioner and the second air-conditioner. The determining unit determines the first processing throughput for the first air-conditioner and the second processing throughput for the second air-conditioner so the power consumption level for the sum of the air-conditioning loads calculated by the calculating unit is minimized or is equal to or less than a predetermined level. The adjusting unit controls the first air-conditioner based on the first processing throughput determined by the determining unit. The adjusting unit also controls the second air-conditioner based on the second processing throughput determined by the determining unit.

In the load processing balance setting apparatus in the fourth aspect of the present invention, the first processing throughput and the second processing throughput are determined so that the power consumption level for the sum of the air-conditioning load of the first air-conditioner and the air-conditioning load of the second air-conditioner is minimized or is equal to or less than a predetermined level. Also, the first air-conditioner and the second air-conditioner are controlled based on the determined first processing throughput and second processing throughput. Accordingly, the overall power consumption level for the air-conditioners is lessened without there being any change in the overall air-conditioning load for the air-conditioners.

Thus, it is possible to conserve energy by adjusting the air-conditioning loads of the air-conditioners.

Advantageous Effects of Invention

It is possible to conserve energy by adjusting the air-conditioning load between the air-conditioners using the load processing balance setting apparatus in the first aspect of the present invention.

A first processing throughput and a second processing throughput can be determined using the load processing balance setting apparatus in the second aspect of the present invention.

A first processing throughput and a second processing throughput can be determined using the load processing balance setting apparatus in the third aspect of the present invention.

It is possible to conserve energy by adjusting the air-conditioning load between the air-conditioners using the load processing balance setting apparatus in the fourth aspect of the present invention.

BRIEF DESCRIPTION OF THE DRAWINGS

FIG. 6 shows tables indicating the optimum processing throughputs for the air-conditioners in Alternate Embodiment (C).

DESCRIPTION OF EMBODIMENTS

The following is a description of the load processing balance setting apparatus 20 of the present invention made with reference to the accompanying drawings.

(1) Overall Configuration

Figure 1:
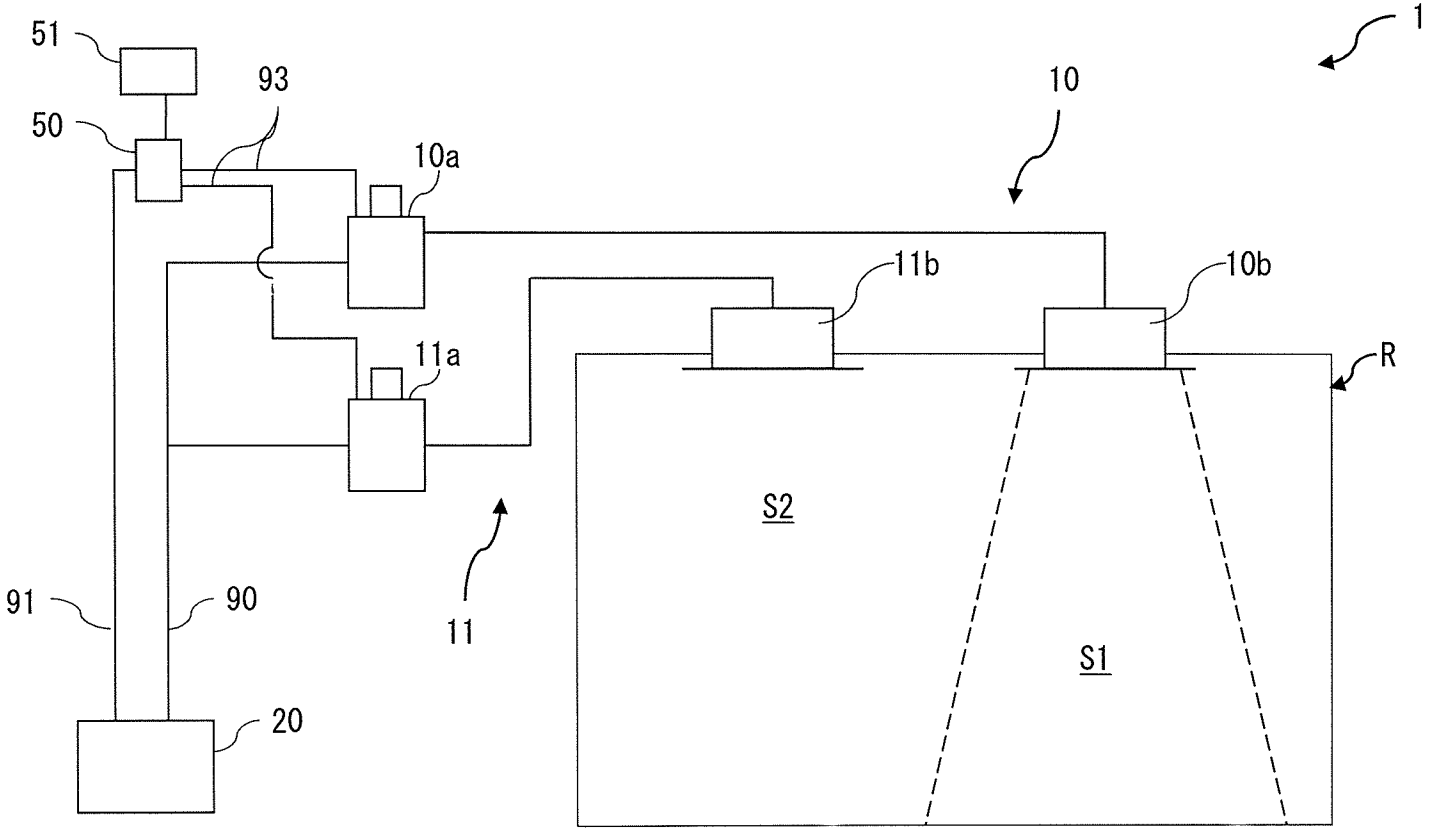
FIG. 1 is a view of an air-conditioning system equipped with a load processing balance setting apparatus according to an embodiment of the present invention.

FIG. 1 is a view of an air-conditioning system 1 equipped with a load processing balance setting apparatus 20 according to an embodiment of the present invention. This air-conditioning system 1 is used in a structure such as an office building and/or an apartment building. This air-conditioning system 1 is composed primarily of a load processing balance setting apparatus 20, a task air-conditioner 10, and an ambient air-conditioner 11.

As shown in FIG. 1, one task air-conditioner 10 and one ambient air-conditioner 11 are installed in a single room R.

The task air-conditioner 10 air-conditions the targeted task area S1 (corresponding to the first area). The task area S1 is an area near people. In other words, it is an area in which a group of people work. The task air-conditioner 10 has one outdoor unit 10*a* and one indoor unit 10*b*.

The ambient air-conditioner 11 air-conditions the targeted ambient area S2 (corresponding to the second area). The ambient area S2 includes the task area S1 within this area. In this embodiment, it is all of the space inside room R. Thus, when air-conditioning is performed by the ambient air-conditioner 11, the task area S1 inside the ambient area S2 is also air-conditioned. The ambient air-conditioner 11 also has one outdoor unit 11*a* and one indoor unit 11*b*.

Also, because the task air-conditioner 10 and the ambient air-conditioner 11 perform air-conditioning differently, different air-conditioning environments can be provided.

In the example explained below, a single task air-conditioner 10 and a single ambient air-conditioner 11 are installed in a single room R. However, a plurality of task air-conditioners and ambient air-conditioners can be installed in a single room, and a plurality of rooms can be so fitted in a single building.

The load processing balance setting apparatus 20 is used to adjust the air-conditioning loads of the air-conditioners 10, 11 so that the total coefficient of performance (COP) of the task air-conditioner 10 and the ambient air-conditioner 11 can be increased. The load processing balance setting apparatus 20 is connected to the outdoor units 10*a*, 11*a* via a communication line for air-conditioning 90 to send control commands to the outdoor units 10*a*, 11*a* or to receiving operating data from the air-conditioners 10, 11. This operating data is data relating to the operating history and data relating to the operating status of the air-conditioners 10, 11. More specifically, the data relating to the operating history is on/off data from the power source 51, on/off data from the thermostat, various operating mode data (specifically, cooling mode, heating mode, fan mode, etc.) and temperature setting data from the indoor units 10*b*, 11*b*. The data relating to the operating status includes values detected by various sensors and gauges installed in the air-conditioners 10, 11 (e.g., the room temperature or intake temperature).

The load processing balance setting apparatus 20 is also connected to a power meter 50 via power supply wiring 91 to receive power consumption data on the air-conditioners 10, 11 sent from the power meter 50.

The power meter 50 is connected to the middle of power supply wiring 93 extending from the output of the power supply 51 to the outdoor units 10*a*, 11*a*, so the power supplied from the power source 51 to the outdoor units 10*a*, 11*a* and the indoor units 10*b*, 11*b* can be measured. Accordingly, the power meter 50 is capable of measuring the power consumption in the air-conditioners 10, 11.

(2) Configuration of Load Processing Balance Setting Apparatus

Figure 2:
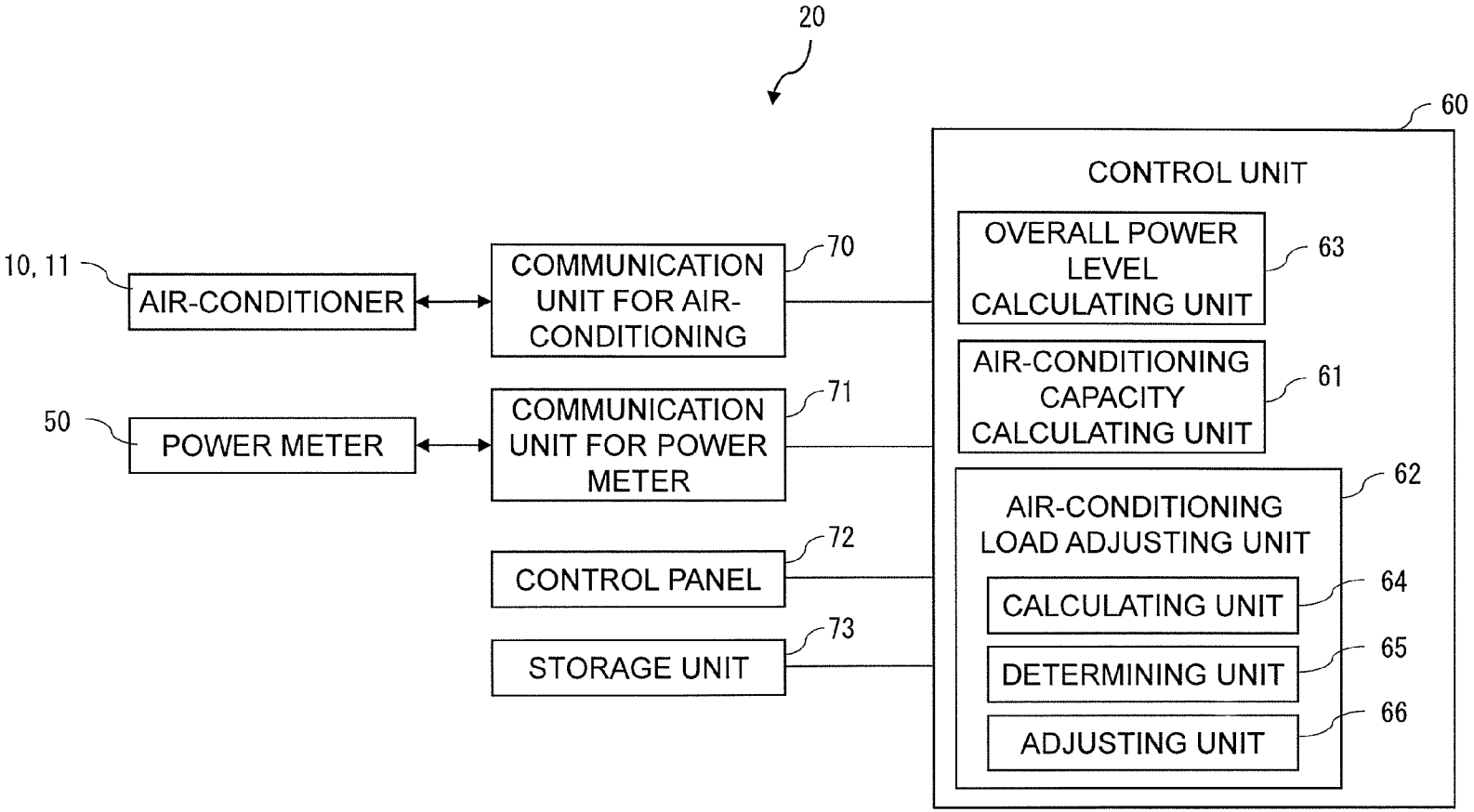
FIG. 2 is a schematic view showing the internal configuration of the load processing balance setting apparatus in the embodiment of the present invention.

The following is an explanation of the configuration of the load processing balance setting apparatus 20 in this embodiment of the present invention. The load processing balance setting apparatus 20 in this embodiment, as shown in FIG. 2, has a communication unit for air-conditioning 70, a communication unit for the power meter 71, a control panel 72, a storage unit 73, and a control unit 60.

The communication unit for air-conditioning 70 is used to communicate with the air-conditioners 10, 11. For example, the communication unit for air-conditioning 70 sends control commands for the indoor units 10*b*, 11*b* to the outdoor units 10*a*, 11*a*, and receives operational data on the air-conditioners 10, 11 from the outside units 10*a*, 11*a* via the communication line for air-conditioning 90. From the operating data, the load processing balance setting apparatus 20 can ascertain the operating times, the opening degree of the indoor expansion valve, the evaporation pressure Pe, and the condensation pressure Pc of the indoor units 10*b*, 11*b*.

The communication unit for the power meter 71 is used to communicate with the power meter 50. The communication unit for the power meter 71 can receive the power consumption level kWh of the air-conditioners 10, 11 from the power meter 50. Here, the power consumption level kWh received by the communication unit for the power meter 71 corresponds to the total amount of power consumed by the air-conditioners 10, 11 at a given time. In other words, the power consumption level kWh received by the communication unit for the power meter 71 is the sum of the current amount of power consumed by the outdoor units 10*a*, 11*a* and the sum of the current amount of power consumed by the indoor units 10*b*, 11*b* connected to these outdoor units 10*a*, 11*a*. In this embodiment, the power consumption level kWh received by the communication unit for the power meter 71 is the total amount of power consumed by the air-conditioners 10, 11 at a given time. However, the present invention is not limited to this embodiment. It can be the current amount of power consumed by a single outdoor unit or the current amount of power consumed by the indoor unit connected to this outdoor unit.

The communication unit for the power meter 71 can acquire the power consumption level kWh every time a predetermined amount of time has elapsed (e.g., one minute).

The control panel 72 can be a touch panel composed of, for example, a liquid crystal display and a matrix switch, and can display various types of screens. Screens displayed on the control panel 72 can include a setting screen related to airflow control of the indoor units 10*b*, 11*b* by the control unit 60, and a screen for turning on and off the indoor units 10*b*, 11*b*. The user of the control panel 72 in the air-conditioning system 1 can turn on and off the indoor units 10*b*, 11*b* and set the airflow controls by directly touching a screen displayed on the control panel 72. The control panel 72 can also display operating data from the air-conditioners 10, 11 such as the various operating mode data and temperature setting data from the indoor units 10*b*, 11*b*, and the room temperature data.

The storage unit 73 is composed of an HDD or flash memory, and can be used to store operating data from the air-conditioners 10, 11. The storage unit 73 can also store overall power consumption levels Etl calculated by the overall power level calculating unit 63 described below. In addition, the storage unit 73 can store the air-conditioning capacity calculated by the air-conditioning capacity calculating unit 61 described below.

The control unit 60 is a microcomputer composed of a CPU and RAM and is used to control the various connected devices. More specifically, the control unit 60 is connected to the communication unit for air-conditioning 70 and the communication unit for the power meter 71 to control communication via these communication units 70, 71. The control unit 60 also generates control commands based on on/off control and airflow control of the indoor units 10*b*, 11*b*.

The control unit 60 has an overall power level calculating unit 63 for calculating the overall power consumption levels Etl of the air-conditioners 10, 11, and an air-conditioning capacity calculating unit 61 for calculating the air-conditioning capacity Q of the air-conditioners.

The overall power level calculating unit 63 calculates the overall power consumption levels Etl of the air-conditioners 10, 11 based on the power consumption levels kWh of the air-conditioners 10, 11. More specifically, the overall power level calculating unit 63 calculates the cumulative values of the power consumption levels kWh of the task air-conditioner 10 or the ambient air-conditioner 11 over a predetermined period of time as the overall power consumption levels Etl of these units. Thus, the overall power consumption level Etl includes overall power consumption level Eo, which is the cumulative value of the amount of power consumed by the outdoor units 10*a*, 11*a* over a predetermined period of time, and overall power consumption level Elk, which is the cumulative value of the amount of power consumed by the indoor units 10*b*, 11*b* over a predetermined period of time. The overall power level calculating unit 63 adds up the amount of power consumed during each period of time (e.g., one hour). Therefore, the overall power level calculating unit 63 adds up the amount of power consumed over the course of one hour, and if one hour has elapsed, the cumulative value is reset, and the amount of power consumed is added up once again.

The air-conditioning capacity calculating unit 61 estimates the air-conditioning capacity Q of the air-conditioners 10, 11 based on the operating data from the air-conditioners 10, 11. More specifically, the air-conditioning capacity calculating unit 61 calculates the air-conditioning capacity by multiplying the enthalpy difference of the evaporator or the condenser by the amount of circulating refrigerant G in the indoor units 10*b*, 11*b*. Here, the air-conditioning capacity during cooling Qc is calculated by multiplying the enthalpy difference of the evaporator Δic by the amount of circulating refrigerant G ($Qc=\Delta ic\times G$), and the air-conditioning capacity during heating Qh is calculated by multiplying the enthalpy difference of the condenser Δih by the amount of circulating refrigerant G ($Qh=\Delta ih\times G$).

Figure 3:
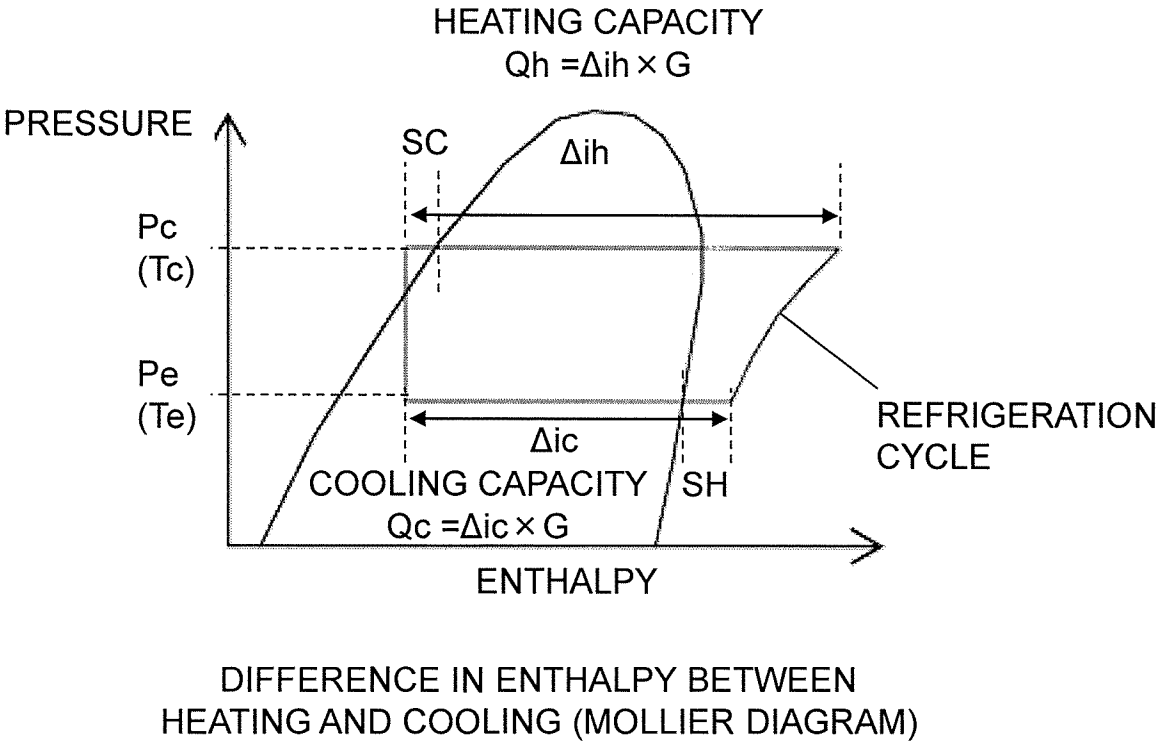
FIG. 3 is a Mollier diagram showing the enthalpy difference during heating and cooling.

The air-conditioning capacity calculating unit 61 estimates the enthalpy differences Δic, Δih and the amount of circulating refrigerant G used in the calculations based on operating data acquired by the communication unit for air-conditioning 70. More specifically, enthalpy differences Δic, Δih are determined using the evaporation pressure Pe, condensation pressure Pc and control target values (degree of superheating SH, degree of supercooling SC) obtained in the operating data acquired by the communication unit for air-conditioning 70, i.e., data related to the operating history of the air-conditioners 10, 11, and data related to the operating status of the air-conditioners 10, 11. FIG. 3 is a Mollier diagram showing the enthalpy difference during heating and cooling in which the horizontal axis indicates the enthalpy and the vertical axis indicates the pressure. FIG. 3 shows the relationships between the evaporation pressure Pe, the condensation pressure Pc, the degree of superheating SH, the degree of supercooling SC, and the enthalpy differences Δic, Δih.

In addition, the air-conditioning capacity calculating unit 61, during calculation of the air-conditioning capacity Qc, Qh, uses the amount of circulating refrigerant G calculated using the saturation temperature corresponding to the evaporation pressure Te and the saturation temperature corresponding to the condensation pressure Tc ($G=f(Te, Tc)$). For a method of calculating the amount of circulating refrigerant G, see ARI:: Standard For Performance Ration of Positive Displacement Refrigerant Compressors and Compressor Units, Standard 540 (2004), Carl C. Hiller: Detailed Modeling and Computer Simulation of Reciprocating Refrigeration Compressors, Proc. of International Compressor Engineering Conference at Purdue (1976), pp 12-16. Here, the saturation temperature corresponding to the evaporation pressure Te and the saturation temperature corresponding to the condensation pressure Tc are variables determined by the evaporation pressure Pe and the condensation pressure Pc.

Estimation of the air-conditioning capacity described above is performed every interval of time used to add up the amount of power consumed (e.g., one hour).

The control unit 60 also has an air-conditioning load adjusting unit 62. The air-conditioning load adjusting unit 62 has a calculating unit 64, a determining unit 65, and an adjusting unit 66.

The calculating unit 64 calculates the sum Qn of the air-conditioning load Qn_t of the task air-conditioner 10 and the air-conditioning load Qn_a of the ambient air-conditioner 11 (Qn=Qn_t+Qn_a), where the air-conditioning load Qn_t of the task air-conditioner 10 is the air-conditioning capacity or calorific value of the task air-conditioner 10 estimated by the air-conditioning capacity calculating unit 61, and where the air-conditioning load Qn_a of the ambient air-conditioner 11 is the air-conditioning capacity or calorific value of the ambient air-conditioner 11 estimated by the air-conditioning capacity calculating unit 61.

The determining unit 65 calculates the optimum processing throughput Qo_t (corresponding to the first processing throughput), which is the air-conditioning capacity (corresponding to the processing throughput) of the task air-conditioner 10, and the optimum processing throughput Qo_a (corresponding to the second processing throughput), which is the air-conditioning capacity (corresponding to the processing throughput) of the ambient air-conditioner 11, subject to the following objective function and limiting conditions in order to determine the optimum processing throughputs Qo_t, Qo_a for the air-conditioners 10, 11 for maximizing the COP for the sum Qn of the air-conditioning loads of the air-conditioners 10, 11 as calculated by the calculating unit 64.

Objective Function: COP=f(Qt)+g(Qa)

Limiting Condition 1: Qn=Qt+Qa

Limiting Condition 2: 0≤Qt≤Rated Capacity of Task Air-conditioner 10

Limiting Condition 3: 0≤Qa≤Rated Capacity of Ambient Air-conditioner 11 f(Qt) is a relational expression of the COP and air-conditioning load for the task air-conditioner 10, and g(Qa) is a relational expression of the COP and air-conditioning load for the ambient air-conditioner 11. These relational expressions are stored in the storage unit 73 as characteristics of the air-conditioners 10, 11. The COP of the air-conditioners 10, 11 can be a device COP or a system COP. In this embodiment, it is a system COP. The system COP is determined by dividing the air-condition capacities Q by the total power consumption levels Etl of the air-conditioners 10, 11 (system COP=Q/Etl). In this embodiment, the COP of the air-conditioners 10, 11 is the system COP. However, the present invention is not limited to this example. The device COP can also be used.

The adjusting unit 66 controls the air-conditioning capacities of the air-conditioners 10, 11 so that the air-conditioning loads of the air-conditioners 10, 11 are set to the optimum processing throughputs Qo_t, Qo_a determined by the determining unit 65. When the optimum processing throughputs Qo_t, Qo_a determined by the determining unit 65 are "0", the adjusting unit 66 forcibly turns off the thermostat to limit the air-conditioning capacities of the air-conditioners 10, 11.

In a case where the air-conditioners 10, 11 have been controlled by the adjusting unit 66, the air-conditioning load adjusting unit 62 calculates the sum Qm of the air-conditioning load Qm_t of the task air-conditioner 10 and the air-conditioning load Qm_a of the ambient air-conditioner 11 (Qm=Qm_t+Qm_a) after the control has been performed, the air-conditioning load Qm_t of the task air-conditioner 10 being the air-conditioning capacity of the task air-conditioner 10 estimated by the air-conditioning capacity calculating unit 61, and the air-conditioning load Qm_a of the ambient air-conditioner 11 being the air-conditioning capacity of the ambient air-conditioner 11 estimated by the air-conditioning capacity calculating unit 61. The air-conditioning load adjusting unit 62 also compares the sum Qn of the air-conditioning load Qn_t of the task air-conditioner 10 and the air-conditioning load Qn_a of the ambient air-conditioner 11 calculated by the calculating unit 64 before the air-conditioning capacity was controlled by the adjusting unit 66 to the sum Qm of the air-conditioning load Qm_t of the task air-conditioner 10 and the air-conditioning load Qm_a of the ambient air-conditioner 11 calculated by the calculating unit 64 after the air-conditioning capacity was controlled by the adjusting unit 66.

When the divergence between sum Qn and sum Qm is equal to or greater than a predetermined value (e.g., five), the determining unit 65 calculates and determines the optimum processing throughput Qo_t for the task air-conditioner 10 and the optimum processing throughput Qo_a for the ambient air-conditioner 11 with sum Qm serving as sum Qn so that the COP is maximized for sum Qn of the air-conditioning loads.

(3) Operation of Load Processing Balance Setting Apparatus

Figure 4:
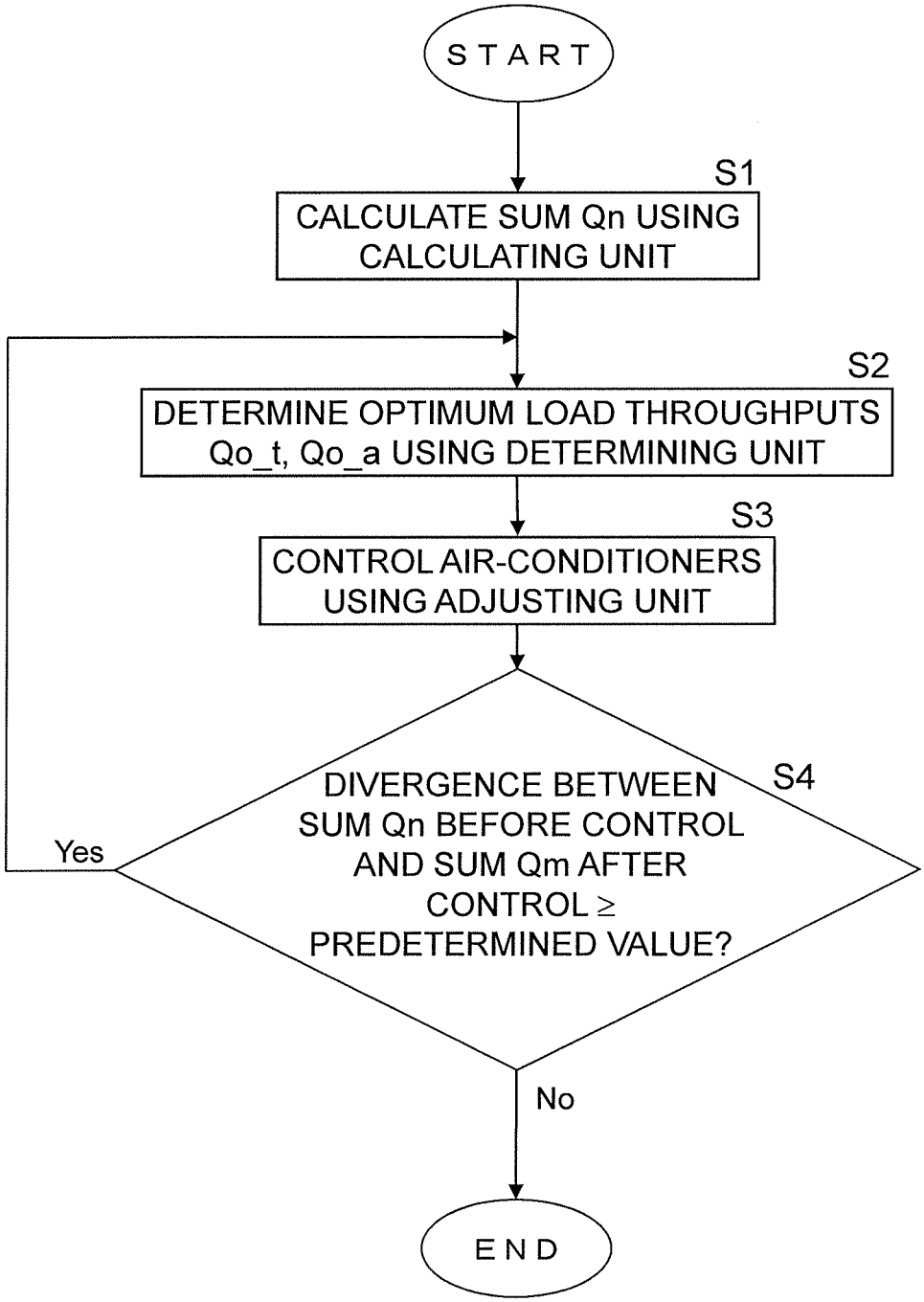
FIG. 4 is a flowchart showing a series of operations performed by the load processing balance setting apparatus.

The following is an explanation of the operations performed by the load processing balance setting apparatus 20 using FIG. 4.

The calculating unit 64 in the load processing balance setting apparatus 20 calculates the sum Qn of the air-conditioning load Qn_t for the task air-conditioner 10 and the air-conditioning load Qn_a for the ambient air-conditioner 11 every time a predetermined time interval elapses (e.g., one hour), where the air-conditioning capacity of the task air-conditioner 10 estimated by the air-conditioning capacity calculating unit 61 is the air-conditioning load Qn_t for the task air-conditioner 10, and the air-conditioning capacity of the ambient air-conditioner 11 estimated by the air-conditioning capacity calculating unit 61 is the air-conditioning load Qn_a for the ambient air-conditioner 11 (Step 51). When sum Qn has been calculated by the calculating unit 64, the determining unit 65 calculates and determines the optimum processing throughput Qo_t for the task air-conditioner 10 and the optimum processing throughput Qo_a for the ambient air-conditioner 11 subject to the objective function and the limiting conditions so that the COP is maximized at sum Qn of the air-conditioning loads of the air-conditioners 10, 11 (Step S2). When the optimum processing throughputs Qo_t, Qo_a of the air-conditioners 10, 11 has been determined by the determining unit 65, the adjusting unit 66 controls the air-conditioners 10, 11 so that the air-conditioning loads of the air-conditioners 10, 11 are at the optimum processing throughputs Qo_t, Qo_a determined by the determining unit 65 (Step S3). Then, the air-conditioning load adjusting unit 62 calculates the sum Qm of the air-conditioning load Qm_t for the task air-conditioner 10 and the air-conditioning load Qm_a for the ambient air-conditioner 11 after the controls performed by the adjusting unit 66. Next, the air-conditioning load adjusting unit 62 compares the sum Qn of the air-conditioning load Qn_t for the task air-conditioner 10 and the air-conditioning load Qn_a for the ambient air-conditioner 11 before the air-conditioning loads were controlled by the adjusting unit 66 to the sum Qm of the air-conditioning load Qm_t for the task air-conditioner 10 and the air-conditioning load Qm_a for the ambient air-conditioner 11 after the air-conditioning loads were controlled by the adjusting unit 66 (Step S4). When, as a result of the comparison performed by the air-conditioning load adjusting unit 62, the divergence between sum Qn and sum Qm is equal to or greater than a predetermined value, the process returns to Step S2. The determining unit 65 calculates and determines the optimum processing throughput Qo_t for the task air-conditioner 10 and the optimum processing throughput Qo_a for the ambient air-conditioner 11 with Qm serving as sum Qn so that the COP is maximized for sum Qn of the air-conditioning loads for the air-conditioners 10, 11. When, as a result of the comparison performed by the air-conditioning load adjusting unit 62, the divergence between sum Qn and sum Qm is not equal to or greater than a predetermined value, the post-control air-conditioning loads for the air-conditioners are maintained. When a predetermined amount of time has elapsed since sum Qn was calculated by the calculating unit 64 (e.g., one hour), the process returns to Step S1, and the sum Qn of the air-conditioning load Qn_t for the task air-conditioner 10 and the air-conditioning load Qn_a for the ambient air-conditioner 11 is again calculated by the calculating unit 64.

The operations of the load processing balance setting apparatus 20 are performed until the air-conditioners 10, 11 have been turned off.

<Characteristics>

(1)

In existing air-conditioning systems having a task air-conditioner and an ambient air-conditioner, the air-conditioning load can be reduced by performing air-conditioning (e.g., the cooling operation or a heating operation) in a work area for a group of people using the task air-conditioner.

In the air-conditioning system 1 having a task air-conditioner 10 and an ambient air-conditioner 11 described in the embodiment above, the optimum processing throughput Qo_t for the task air-conditioner 10 and the optimum processing throughput Qo_a for the ambient air-conditioner 11 are determined so that the COP is maximized for the sum Qn of the air-conditioning loads for the air-conditioners 10, 11, and the air-conditioning capacity of the air-conditioners 10, 11 is controlled so that the air-conditioning loads of the air-conditioners 10, 11 match the determined optimum processing throughputs Qo_t, Qo_a. As a result, the overall COP can be improved for the air-conditioners 10, 11 without changing the overall air-conditioning load for the air-conditioners 10, 11.

By adjusting the air-conditioning loads of the air-conditioners 10, 11 in this way, energy conservation can be realized.

(2)

In the embodiment described above, the optimum processing throughput Qo_t for the task air-conditioner 10 and the optimum processing throughput Qo_a for the ambient air-conditioner 11 are calculated subject to an objective function and limiting conditions so that the COP is maximized for the sum Qn of the air-conditioning loads for the air-conditioners 10, 11 as calculated by the calculating unit 64, thereby determining the optimum processing throughputs Qo_t, Qo_a for the air-conditioners 10, 11. In this way, the optimum processing throughputs Qo_t, Qo_a for the air-conditioners 10, 11 can be determined by the load processing balance setting apparatus 20.

<Alternate Embodiments>

(A)

In the embodiment described above, the calculating unit 64 calculates the sum Qn of the air-conditioning load Qn_t of the task air-conditioner 10 and the air-conditioning load Qn_a of the ambient air-conditioner 11, where the air-conditioning load Qn_t of the task air-conditioner 10 is the air-conditioning capacity of the task air-conditioner 10 estimated by the air-conditioning capacity calculating unit 61, and the air-conditioning load Qn_a of the ambient air-conditioner 11 is the air-conditioning capacity of the ambient air-conditioner 11 estimated by the air-conditioning capacity calculating unit 61.

Instead, the sum of the air-conditioning loads for the air-conditioners as calculated by the calculating unit can be the sum of the air-conditioner load factors for the air-conditioners. Here, the calculating unit calculates the air-conditioning load factors for the air-conditioners within a predetermined time period based on operating data from the air-conditioners. More specifically, the air-conditioning load factor is determined using the following equation:

$$\text{Air-conditioning Load Factor [\%]}=(\Sigma Qc/\Sigma H)/Qr$$

Here, Qr is the rated capacity [kW].

The calculating unit also calculates the sum of the air-conditioning load factors calculated for each air-conditioner. In this way, the determining unit can calculate and determine the optimum processing throughputs based on the sum of the air-conditioning load factors calculated by the calculating unit. The adjusting unit then controls the air-conditioning capacity of each air-conditioner based on the determined optimum processing throughputs.

Figure 5:
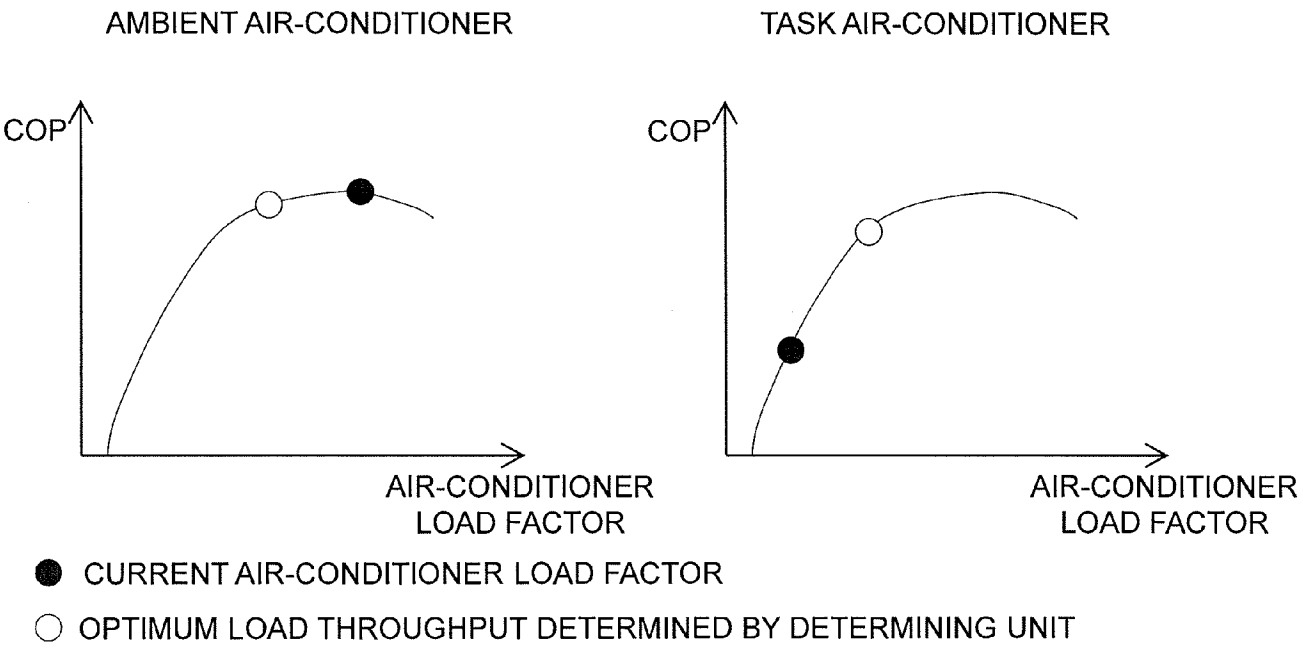
FIG. 5 illustrates graphs showing the relationship between the air-conditioning load factors and the COP (coefficient of performance) of the air-conditioners.

For example, as shown in FIG. 5, the air-conditioning load factor for the ambient air-conditioner is reduced by 10% and the air-conditioning load factor for the task air-conditioner is increased by 10% to reduce the COP for the ambient air-conditioner by 5% but increase the COP for the task air-conditioner by 30%. This improves the overall COP without changing the overall air-conditioning load factor for the task air-conditioner and the ambient air-conditioner.

(B)

In this embodiment, the air-conditioning capacities for the air-conditioners 10, 11 are controlled by the adjusting unit 66 so that the air-conditioning loads of the air-conditioners 10, 11 match the optimum processing throughputs Qo_t, Qo_a determined by the determining unit 65.

Instead, the current air-conditioning loads Qn_t, Qn_a for the air-conditioners can be compared to the calculated optimum processing throughputs Qo_t, Qo_a. When the current air-conditioning loads Qn_t, Qn_a are greater than the optimum processing throughputs Qo_t, Qo_a, the air-conditioning capacities can be controlled so that the processing throughputs of the air-conditioners match the optimum processing throughputs.

For example, the adjusting unit compares the current air-conditioning loads Qn_t, Qn_a to the calculated optimum processing throughputs Qo_t, Qo_a for the task air-conditioner and the ambient air-conditioner. When, as a result of the comparison of the current air-conditioning loads Qn_t, Qn_a to the calculated optimum processing throughputs Qo_t, Qo_a, the current air-conditioning loads Qn_t, Qn_a are greater than the optimum processing throughputs Qo_t, Qo_a, the adjusting unit reduces the air-conditioning capacities so that the air-conditioning loads of the air-conditioners match the optimum processing throughputs.

More specifically, the adjusting unit compares the current air-conditioning load Qn_t to the calculated optimum processing throughput Qo_t for the task air-conditioner. When the current air-conditioning load Qn_t is greater than the optimum processing throughput Qo_t, the adjusting unit reduces the air-conditioning capacity so that the processing throughput of the task air-conditioner matches the optimum processing throughput Qo_t. The adjusting unit also compares the current air-conditioning load Qn_a to the calculated optimum processing throughput Qo_a for the ambient air-conditioner. When the current air-conditioning load Qn_a is greater than the optimum processing throughput Qo_a, the adjusting unit reduces the air-conditioning capacity so that the processing throughput of the ambient air-conditioner matches the optimum processing throughput Qo_a.

Methods that can be used to reduce the air-conditioning capacity include lowering the upper limit value for the INV frequency of the compressor, lowering the upper limit value for the current of the air-conditioning system, raising the evaporating temperature during cooling and lowering the condensing temperature during heating, and raising the temperature setting during cooling and lowering the temperature setting during heating.

(C)

In the embodiment described above, the optimum processing throughput Qo_t for the task air-conditioner 10 and the optimum processing throughput Qo_a for the ambient air-conditioner 11 are calculated by the determining unit 65 subject to an objective function and limiting conditions so that the COP is maximized for the sum Qn of the air-conditioning loads for the air-conditioners 10, 11 as calculated by the calculating unit 64, thereby determining the optimum processing throughputs Qo_t, Qo_a for the air-conditioners 10, 11.

Instead, the optimum processing throughputs Qo_t, Qo_a can be determined based on setting values stored beforehand in the storage unit for the sum Qn and the current air-conditioning load Qn_t for the task air-conditioner, or the sum Qn and the current air-conditioning load Qn_a for the ambient air-conditioner (see FIG. 6). In FIG. 6, "no control" is performed when the optimum processing throughput for the ambient air-conditioner is the sum Qn minus the optimum processing throughput Qo_t for the task air-conditioner (Qo_a=Qn−Qo_t), and when the optimum processing throughput for the task air-conditioner is the sum Qn minus the optimum processing throughput Qo_a for the ambient air-conditioner (Qo_t=Qn−Qo_a).

For example, the determining unit determines the optimum processing throughput Qo_t for the task air-conditioner is 0 when the sum Qn (corresponding to the current total air-conditioning load kWh in FIG. 6) is from 0 to 5, and the air-conditioning load Qn_t for the task air-conditioner (corresponding to the current air-conditioning load kWh for the task air-conditioner in FIG. 6) is from 0 to 5. Also, the determining unit determines that the optimum processing throughput Qo_a for the ambient air-conditioner is the sum Qn minus the optimum processing throughput Qo_t for the task air-conditioner or Qn (Qo_a=Qn−0; see FIG. 6) when the sum Qn is from 0 to 5, and the optimum processing throughput Qo_t of the task air-conditioner has been determined to be 0.

Also, for example, the determining unit determines the optimum processing throughput Qo_a for the ambient air-conditioner from the current air-conditioning load Qn_a of the ambient air-conditioner when the sum Qn is from 10 to 15 and the air-conditioning load Qn_t for the task air-conditioner is from 0 to 5. Here, when the optimum processing throughput Qo_a for the ambient air-conditioner has been determined to be 0, the determining unit determines that the optimum processing throughput Qo_t for the task air-conditioner is the sum Qn minus the optimum processing throughput Qo_a for the ambient air-conditioner or Qn (Qo_t=Qn−0).

Also, for example, the optimum processing throughput Qo_t for the task air-conditioner is determined to be 12 when the sum Qn is from 10 to 15 and the air-conditioning load Qn_t of the task air-conditioner is from 10 to 15. Also, when it has been determined that the sum Qn is from 10 to 15 and that the optimum processing throughput Qo_t for the task air-conditioner is 12, the optimum processing throughput Qo_a for the ambient air-conditioner is determined to be the sum Qn minus the optimum processing throughput Qo_t for the task air-conditioner or Qn−12 by the determining unit.

Here, the air-conditioning load and the processing throughput are the required air-conditioning capacity or calorific value kWh. The setting values in FIG. 6 are those used in this example. These setting values can be changed by, for example, the user.

By determining the optimum processing throughputs Qo_t, Qo_a based on setting values stored beforehand in the storage unit, compared to the case where the determining unit determine the optimum processing throughputs using an objective function, etc., arithmetic operations needed to determine the optimum processing throughputs can be eliminated.

(D)

In the embodiment described above, the determining unit 65 determines the optimum processing throughput Qo_t for the task air-conditioner 10 and the optimum processing throughput Qo_a for the ambient air-conditioner 11 so that the COP is maximized for the sum Qn of the air-conditioning loads.

Instead, a determining unit can determine the optimum processing throughput Qo_t for a task air-conditioner and the optimum processing throughput Qo_a for an ambient air-conditioner so that the amount of power consumed for the sum Qn of the air-conditioning loads is minimized.

Figure 7:
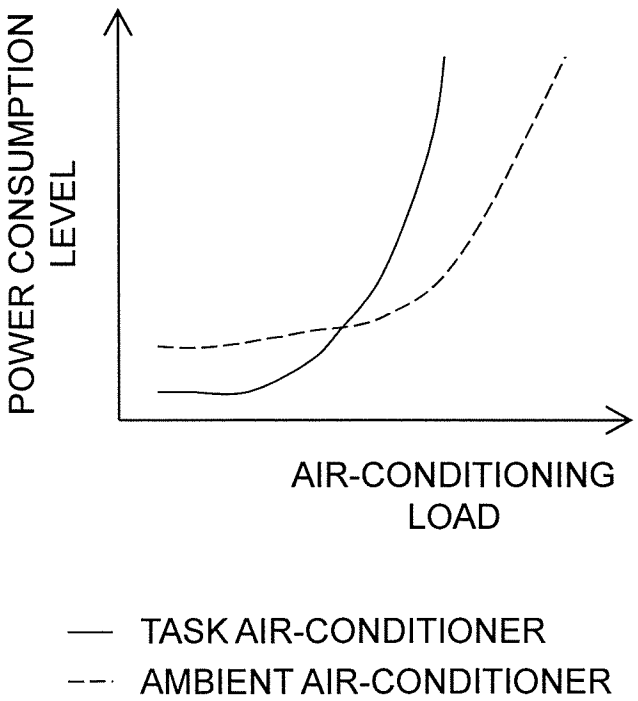
FIG. 7 is a graph showing an example of the relationship between the air-conditioning loads and the power consumption level for the air-conditioners in Alternate Embodiment (D).
Figure 8:
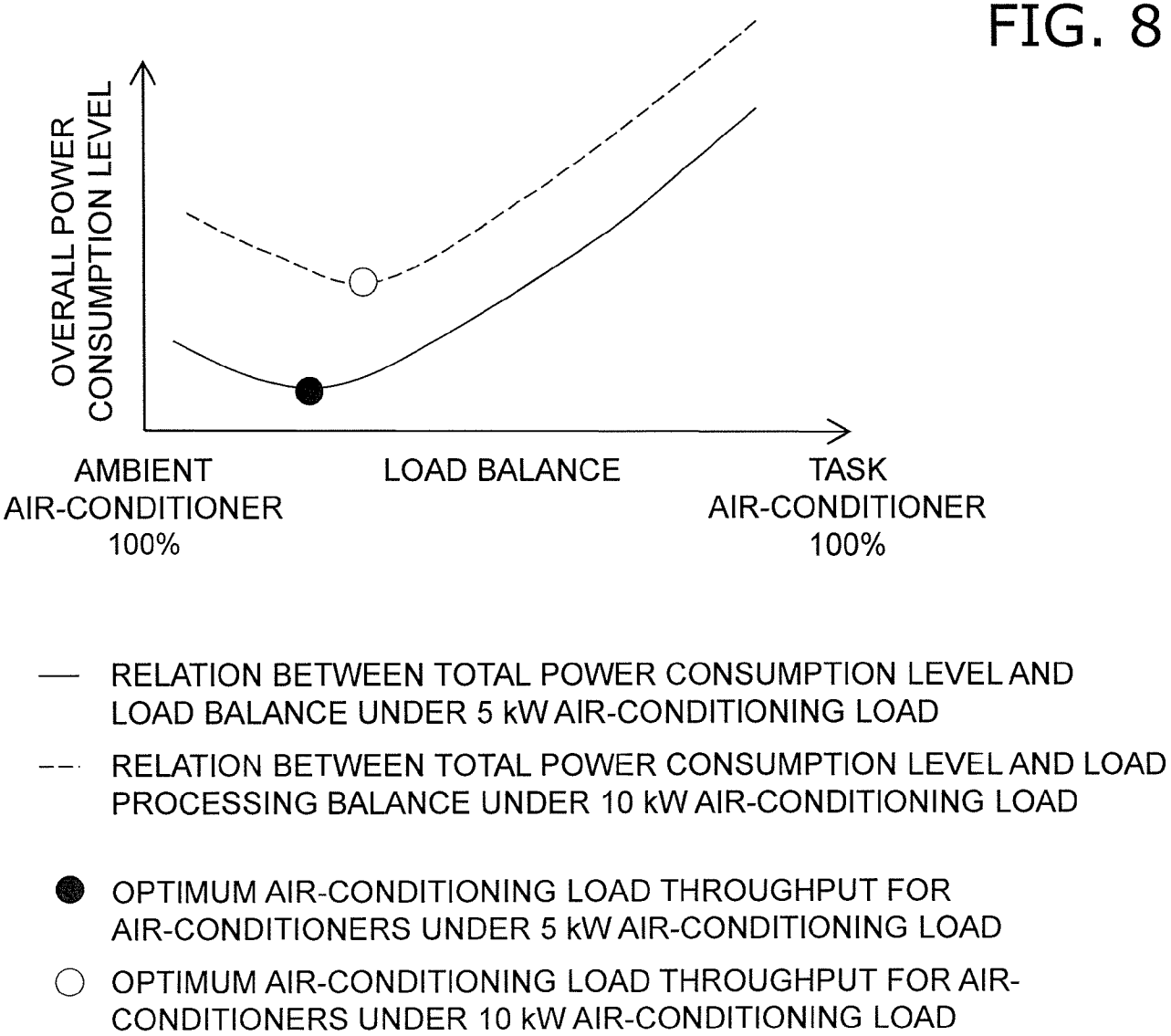
FIG. 8 is a graph showing the overall power consumption level and the air-conditioning loads for the air-conditioners in Alternate Embodiment (D).

For example, as shown in FIG. 7, the relationship between the air-conditioning load and the power consumption level is different for each air-conditioner. Thus, when there is a plurality of air-conditioners, the overall power consumption level, that is, the total amount of power differs depending on the air-conditioning load for each air-conditioner (corresponding to the load balance in FIG. 8) (See FIG. 8). Optimum processing throughputs Qo_t, Qo_a are determined for each air-conditioner so the power consumption level is minimized for the sum Qn of the air-conditioning loads for the air-conditioners, and the air-conditioners are controlled accordingly to realize energy conservation.

Here, objective function f(Qt) is the relational expression for the power consumption level and air-conditioning load of the task air-conditioner, and objective function g(Qa) is the relational expression for the power consumption level and air-conditioning load of the ambient air-conditioner.

Alternatively, the determining unit can determine the optimum processing throughput Qo_t for the task air-conditioner and the optimum processing throughput Qo_a for the ambient air-conditioner so the power consumption level for the sum Qn of the air-conditioning loads is equal to or less than a predetermined level. Here, the predetermined level corresponds to a range from the minimum amount to a predetermined amount for the amount of power consumed for the sum Qn for the air-conditioning loads of the air-conditioners. The predetermined amount is less than the total of the current amount of power consumed by each air-conditioner but greater than the minimum amount.

(E)

In this embodiment, the determining unit 65 calculates the optimum processing throughput Qo_t for the task air-conditioner 10 and the optimum processing throughput Qo_a for the ambient air-conditioner 11 so that the COP is maximized for the sum Qn of the air-conditioning loads for the air-conditioners 10, 11, thereby determining the optimum processing throughputs Qo_t, Qo_a for the air-conditioners 10, 11.

Instead, the determining unit can calculate the optimum processing throughput Qo_t for the task air-conditioner and the optimum processing throughput Qo_a for the ambient air-conditioner so that the COP is equal to or greater than a predetermined level for the sum Qn of the air-conditioning loads for the air-conditioners.

Here, the predetermined level corresponds to a range from the maximum amount to a predetermined value for the COP for the sum Qn for the air-conditioning loads of the air-conditioners. The predetermined value is greater than the sum of the COP for each air-conditioner at the current air-conditioning loads of each air-conditioner but less than the maximum value for the COP for the sum Qn.

INDUSTRIAL APPLICABILITY

Because the present invention enables energy to be conserved by adjusting the air-conditioning load of the air-conditioners, it can be effectively applied to air-conditioning systems equipped with a plurality of air-conditions, especially a task air-conditioner and an ambient air-conditioner.

What is claimed is:

1. A load processing balance setting apparatus comprising:

a first air-conditioner arranged to air-condition a targeted first area;

a second air-conditioner arranged to air-condition a targeted second area having the first area included within the second area;

a calculating unit configured to calculate a sum of an air-conditioning load for the first air-conditioner and the second air-conditioner;

a determining unit configured to determine a first processing throughput for the first air-conditioner and a second processing throughput for the second air-conditioner so that a COP (Coefficient of Performance) for the sum of the air-conditioning loads calculated by the calculating unit is maximized or is equal to or greater than a predetermined level; and an adjusting unit configured to control the first air-conditioner based on the first processing throughput determined by the determining unit, and configured to control the second air-conditioner based on the second processing throughput.

2. The load processing balance setting apparatus according to claim 1, wherein the determining unit is further configured to determine the first processing throughput and the second processing throughput by performing an arithmetic calculation to maximize an objective function related to the COP subject to a limiting condition.

3. The load processing balance setting apparatus according to claim 1, wherein the determining unit is further configured to determine the first processing throughput and the second processing throughput based on a setting value in advance for the sum of the air-conditioning loads.

4. A load processing balance setting apparatus comprising:

a first air-conditioner arranged to air-condition a targeted first area;

a second air-conditioner arranged to air-condition a targeted second area having the first area included within the second area;

a calculating unit configured to calculate a sum of air-conditioning loads for the first air-conditioner and the second air-conditioner;

a determining unit configured to determine a first processing throughput for the first air-conditioner and a second processing throughput for the second air-conditioner so that a power consumption level for the sum of the air-conditioning loads calculated by the calculating unit is minimized or is equal to or less than a predetermined level; and an adjusting unit configured to control the first air-conditioner based on the first processing throughput determined by the determining unit, and configured to control the second air-conditioner based on the second processing throughput determined by the determining unit.

* * * * *